US009154879B2

(12) United States Patent
Yoo et al.

(10) Patent No.: US 9,154,879 B2
(45) Date of Patent: Oct. 6, 2015

(54) METHOD AND APPARATUS FOR PROCESSING AUDIO SIGNAL AND AUDIO PLAYBACK SYSTEM

(71) Applicant: Electronics and Telecommunications Research Institute, Daejeon (KR)

(72) Inventors: Jae Hyoun Yoo, Daejeon (KR); Keun Woo Choi, Seoul (KR); Jeong Il Seo, Daejeon (KR); Kyeong Ok Kang, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 265 days.

(21) Appl. No.: 13/834,936

(22) Filed: Mar. 15, 2013

(65) Prior Publication Data

US 2013/0322666 A1 Dec. 5, 2013

(30) Foreign Application Priority Data

May 31, 2012 (KR) ..... 10-2012-0058611

(51) Int. Cl.
*H04R 5/04* (2006.01)
*H04R 3/12* (2006.01)

(52) U.S. Cl.
CPC .. *H04R 5/04* (2013.01); *H04R 3/12* (2013.01); *H04R 2203/12* (2013.01)

(58) Field of Classification Search
CPC ..... H04R 5/04; H04R 3/12; H04R 2203/12
USPC ..... 381/300, 17, 59, 303, 304, 182
See application file for complete search history.

(56) References Cited

U.S. PATENT DOCUMENTS

| | | | | |
|---|---|---|---|---|
| 7,804,972 | B2 | 9/2010 | Melanson | |
| 2006/0126878 | A1 | 6/2006 | Takumai et al. | |
| 2007/0230724 | A1 | 10/2007 | Konagai et al. | |
| 2010/0329480 | A1 * | 12/2010 | Boone | 381/94.1 |
| 2012/0020480 | A1 * | 1/2012 | Visser et al. | 381/17 |

* cited by examiner

*Primary Examiner* — Melur Ramakrishnaiah
(74) *Attorney, Agent, or Firm* — William Park & Associates Ltd.

(57) ABSTRACT

A Method for processing an audio signal to use a beamforming technique in a three-dimensional (3D) space is disclosed. The method may include generating a beamforming signal on a horizontal plane related to a sound source in a three-dimensional (3D) space and modulating the beamforming signal to head for a listener in the 3D space from the sound source.

14 Claims, 10 Drawing Sheets

METHOD AND APPARATUS FOR PROCESSING AUDIO SIGNAL AND AUDIO PLAYBACK SYSTEM

CROSS-REFERENCE TO RELATED APPLICATION

This application claims the priority benefit of Korean Patent Application No. 10-2012-0058611, filed on May 31, 2012, in the Korean Intellectual Property Office, the disclosure of which is incorporated herein by reference.

BACKGROUND

1. Field of the Invention

The present invention relates to a method for processing an audio signal, and more particularly, to a method for processing an audio signal to use a beamforming technique in a three-dimensional (3D) space.

2. Description of the Related Art

Beamforming is a technique that is widely used in various fields to enable a wavelength of a sound to be reproduced in a desired direction. In this technique, a user may selectively record sounds from a desired direction using a beamforming technique, and a loudspeaker array including a plurality of loudspeakers is used to control a reproduced sound or to output a sound to a particular position.

The user modulates sound output by each loudspeaker included in the loudspeaker array, thereby achieving a directivity of an audio signal. More particularly, the directivity of the audio signal may be realized by overlapping a plurality of audio signals to increase an intensity of the plurality of audio signals in a particular direction using phase differences between the plurality of audio signals.

Conventional technology for reproducing a sound source using beamforming is performed on a two-dimensional (2D) plane. Thus, the conventional beam forming technique may not be adopted as in a case of a loudspeaker array disposed in a three-dimensional (3D) space.

Accordingly, there is a demand for a new method for processing an audio signal to output a beam forming signal through a loudspeaker array disposed in the 3D space.

SUMMARY

An aspect of the present invention provides an audio signal processing method that enables beamforming of an audio signal in a loudspeaker array disposed in a three-dimensional (3D) space by modulating a beamforming signal on a horizontal plane related to a sound source.

Another aspect of the present invention also provides an audio playback system that is able to output a beamforming signal in a direction of a position of a listener in an environment of a loudspeaker array in a 3D space.

According to an aspect of the present invention, there is provided a method for processing an audio signal, the method including generating a beamforming signal on a horizontal plane related to a sound source in a 3D space and modulating the beamforming signal to be directed to a listener in the 3D space from the sound source.

According to an aspect of the present invention, there is provided an apparatus for processing an audio signal, the apparatus including a generating unit to generate a beamforming signal on a horizontal plane related to a sound source in a 3D space and a modulating unit to modulate the beamforming signal to head for a listener in the 3D space from the sound source.

According to an aspect of the present invention, there is provided an audio playback system including an audio signal processing apparatus to generate a beamforming signal on a horizontal plane related to a sound source in a 3D space and to modulate the beamforming signal to be directed to a listener in the 3D space from the sound source, and a loudspeaker array to output the beamforming signal modulated by the audio signal processing apparatus through a plurality of loudspeakers.

According to an aspect of the present invention, an input audio signal is generated into a beamforming signal on a horizontal plane, which is modulated based on a position of a listener, thereby employing a beamforming technique in a loudspeaker array disposed in a 3D space.

BRIEF DESCRIPTION OF THE DRAWINGS

These and/or other aspects, features, and advantages of the invention will become apparent and more readily appreciated from the following description of exemplary embodiments, taken in conjunction with the accompanying drawings of which.

DETAILED DESCRIPTION

Figure 1:
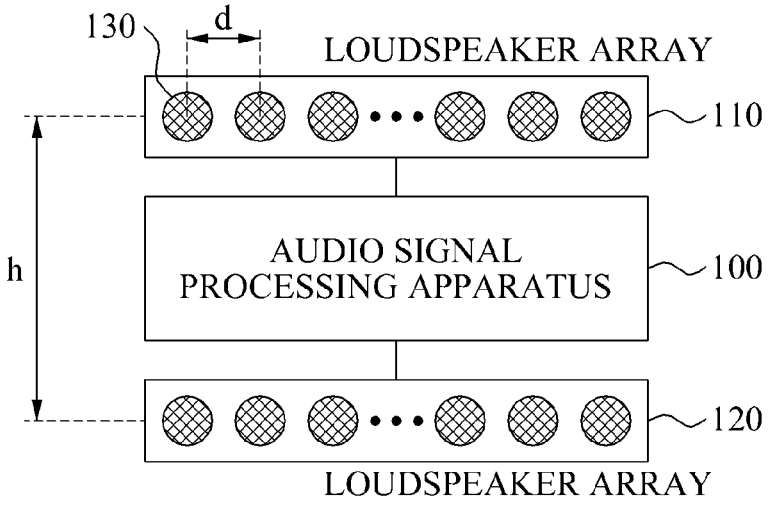
FIG. 1 illustrates an overall configuration of an audio playback system according to an embodiment of the present invention.

Reference will now be made in detail to exemplary embodiments of the present invention, examples of which are illustrated in the accompanying drawings, wherein like reference numerals refer to the like elements throughout. A method for processing an audio signal, also referred to as an "audio signal processing method" according to an exemplary embodiment may be carried out by an apparatus for processing an audio signal, also referred to as an "audio signal processing apparatus". Exemplary embodiments are described below to explain the present invention by referring to the figures.

FIG. 1 illustrates an overall configuration of an audio playback system according to an exemplary embodiment of the present invention.

Referring to FIG. 1, the audio playback system may include an audio signal processing apparatus 100 and loudspeaker arrays 110 and 120.

The audio playback system may receive an audio signal to generate a beamforming signal through the audio signal processing apparatus 100 and output the beamforming signal through the loudspeaker arrays 110 and 120.

The audio signal processing apparatus 100 may generate a beamforming signal on a horizontal plane related to a sound source in a three-dimensional (3D) space and modulate the beamforming signal to head for a listener in the 3D space from the sound source.

The audio signal processing apparatus 100 outputs an audio signal based on a predetermined delay time from each loudspeaker 130 forming the loudspeaker arrays 110 and 120, thereby generating the beamforming signal on the horizontal plane related to the sound source. Here, the predetermined delay time may be set using a separation distance between loudspeakers 130 forming the loudspeaker arrays 110 and 120 and a beam angle on the horizontal plane related to the sound source.

The audio signals, output based on a predetermined delay time, are output with mutually overlapping waves thereby enabling the audio signals to have a constant beam angle. That is, the audio signals may be output in a form of sound pressure concentrated in a particular direction. The audio signal processing apparatus 100 may modulate the predetermined delay time with respect to an output of each loudspeaker, thereby determining a beam angle of an output audio signal.

The audio signal processing apparatus 100 may modulate the beamforming signal using the beamforming signal on the horizontal plane related to the sound source in the 3D space and the beam angle from the sound source to the listener. Further, the audio signal processing apparatus 100 may modulate the beamforming signal by applying a difference value based on the beamforming signal on the horizontal plane and the beam angle to the listener.

That is, the audio signal processing apparatus 100 may compensate for the sound source due to a difference value related to a position of the listener in the beamforming signal on the horizontal plane, thereby generating the beamforming signal in the loudspeaker arrays 110 and 120 disposed in the 3D space.

The loudspeaker arrays 110 and 120, that is, a system including a plurality of loudspeakers 130, may modulate a direction of a sound to be reproduced through the plurality of loudspeakers 130 or output a sound to be focused on a particular position. Although FIG. 1 illustrates the loudspeaker arrays 110 and 120 including the loudspeakers 130 as being disposed linearly, the loudspeaker arrays 110 and 120 may be configured in various dispositions, and is not limited to the linear arrangement.

A plurality of the loudspeaker arrays 110 and 120 disposed in the 3D space. FIG. 1 illustrates an upper loudspeaker array 110 and a lower loudspeaker array 120, however, the number and positioning of the loudspeaker arrays 110 and 120 is not limited thereto. That is, unlike in FIG. 1, the loudspeaker arrays 110 and 120 may be disposed vertically to the horizontal plane or be disposed at a predetermined angle in the 3D space.

The following description is based on a case in which the upper loudspeaker array 110 and the lower loudspeaker array 120 are disposed at a distance of h meters on a surface perpendicular to the loudspeaker arrays 110 and 120, and a loudspeaker 130 in each of the loudspeaker arrays 110 and 120 is disposed at a separation distance of d meters.

The loudspeaker arrays 110 and 120 may output the beamforming signal, modulated by the audio signal processing apparatus 100 to be directed to the position of the listener, through the plurality of loudspeakers 130. The output beamforming signal may be focused on the position of the listener with waves of the audio signals overlapping each other.

Figure 2:
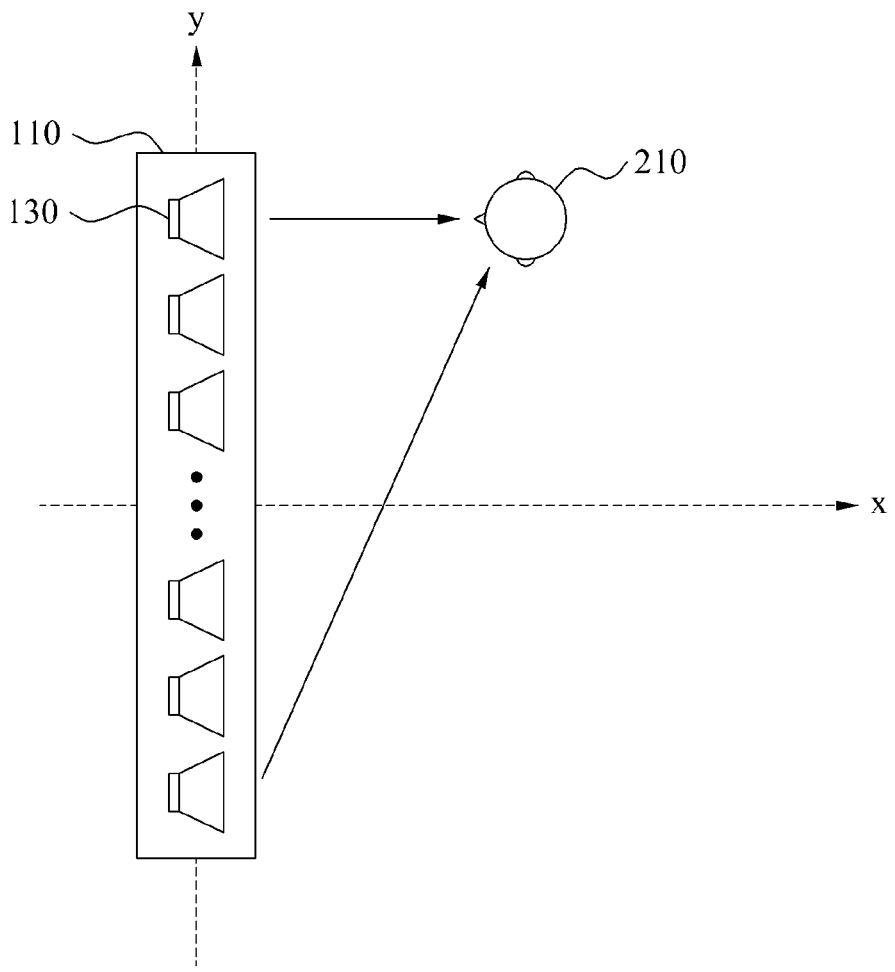
FIG. 2 illustrates a beamforming signal viewed from a plane horizontal to a loudspeaker array according to an exemplary embodiment of the present invention.

FIG. 2 illustrates an example of a beamforming signal viewed from a horizontal plane to a loudspeaker array according to an exemplary embodiment of the present invention.

Referring to FIG. 2, the audio signal processing apparatus may focus a sound on a desired position 210 on the horizontal plane including the loudspeaker array 110, that is, an x-y coordinate plane, based on a beamforming theory. FIG. 2 illustrates a beamforming signal that is output on the horizontal plane where an upper loudspeaker array 110 is present. The loudspeakers 130 included in the loudspeaker array 110 each output an audio signal based on a predetermined delay time, thereby generating a beamforming signal on the horizontal plane on which the loudspeaker array 110 is present, that is, the x-y plane.

Figure 3A:
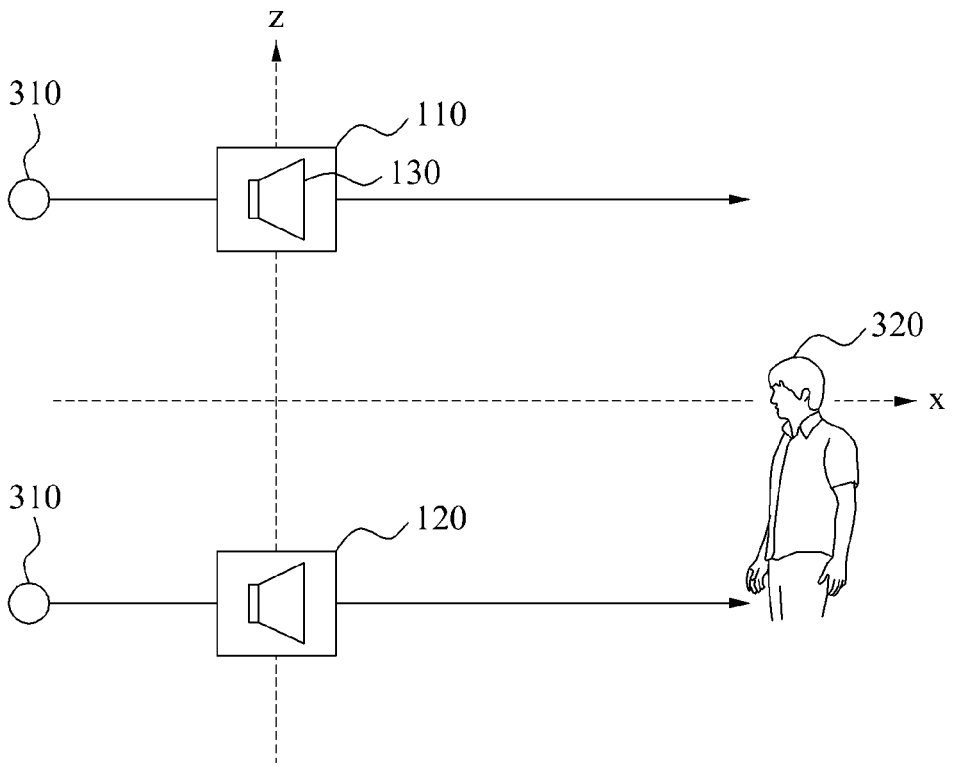
FIGS. 3A and 3B illustrate a beamforming signal viewed from a surface perpendicular to a loudspeaker array according to an exemplary embodiment of the present invention.
Figure 3B:
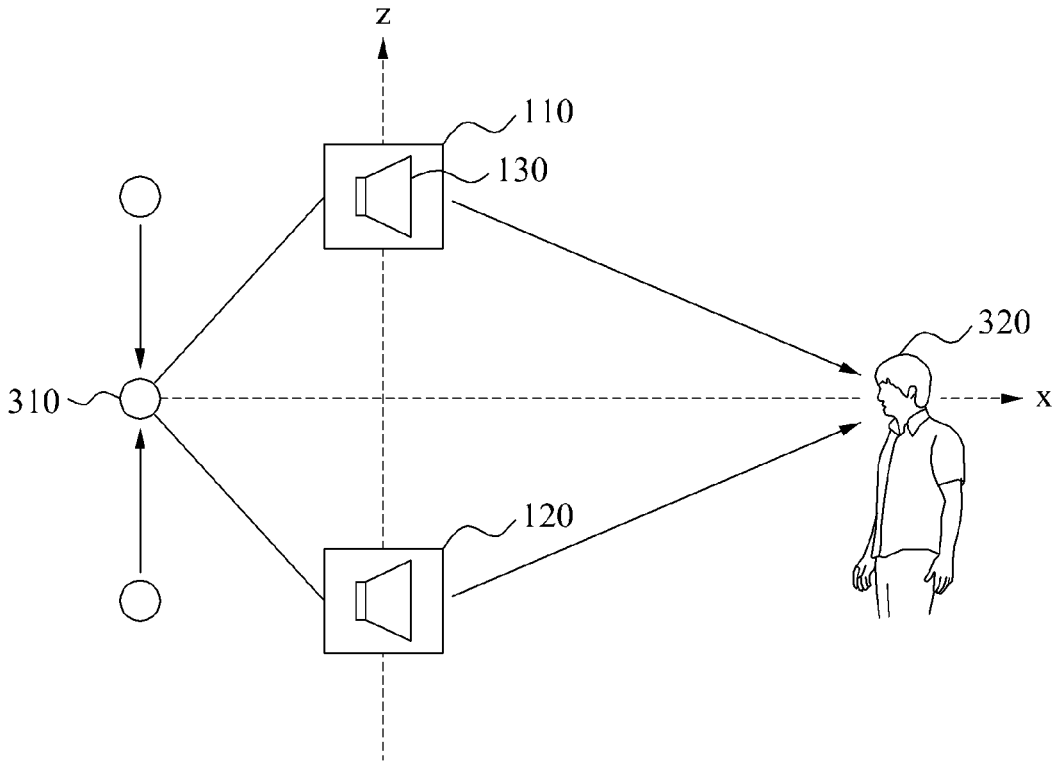

FIGS. 3A and 3B illustrate an example of a beamforming signal viewed from a surface perpendicular to a loudspeaker array according to an exemplary embodiment of the present invention.

FIG. 3A illustrates a beamforming signal output on a horizontal plane to the loudspeaker arrays 110 and 120, that is, the x-y coordinate plane in an environment in which an upper loudspeaker array 110 and a lower loudspeaker array 120 are disposed. The audio signal processing apparatus may delay an output of each loudspeaker so that a sound source 310 on the horizontal plane is output in a form of a beamforming signal, thereby outputting an audio signal in a desired direction.

In FIG. 3A, a listener 320 is located between the upper loudspeaker array 110 and the lower loudspeaker array 120, however, a sound is output in a direction of the horizontal plane on which each sound source 310 is disposed. That is, when the listener 320 is located on the horizontal plane on which the loudspeaker arrays 110 and 120 are disposed, the audio signal processing apparatus may delay the output of the loudspeakers, thereby outputting the beamforming signal to the position of the listener 320.

However, when the listener 320 is positioned between the loudspeaker arrays 110 and 120 as in FIG. 3A, the audio signal processing apparatus may not focus an audio signal on the position of the listener 320 by delaying the output.

FIG. 3B illustrates a case in which the sound source 310 and the listener 320 are disposed between the loudspeaker arrays 110 and 120. Here, the audio signal processing apparatus may need to guide a beamforming signal along the horizontal plane to the loudspeaker arrays 110 and 120 to be directed to the position of the listener 320 in the 3D space in order to output the sound source 310 positioned between the loudspeaker arrays 110 and 120 as a beamforming signal to the position of the listener 320.

To this end, the audio signal processing apparatus may modulate the beamforming signal on the horizontal plane with the loudspeaker arrays 110 and 120 and compensate for a difference value in the beamforming signal due to a beam angle to the listener 320.

Figure 4:
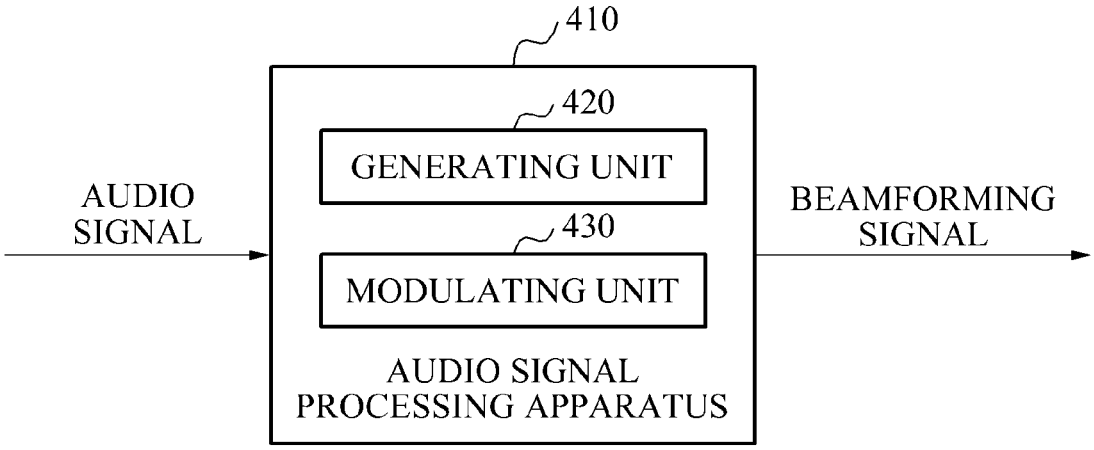
FIG. 4 illustrates a detailed configuration of an audio signal processing apparatus according to an exemplary embodiment of the present invention.

FIG. 4 illustrates a configuration of an audio signal processing apparatus according to an exemplary embodiment of the present invention.

Referring to FIG. 4, the audio signal processing apparatus 410 may include a generating unit 420 and a modulating unit 430.

The generating unit 420 may generate a beamforming signal on a horizontal plane related to a sound source in a 3D space. That is, the generating unit 420 may generate the beamforming signal on the horizontal plane on which the sound source is disposed using a beamforming theory. Here, the sound source may be generated based on at least one loudspeaker array.

The generating unit 420 generates the beamforming signal by outputting an audio signal based on a predetermined delay time from each loudspeaker forming a loudspeaker array. Here, the predetermined delay time may be set using a separation distance between loudspeakers forming the loudspeaker array and a beam angle on the horizontal plane related to the sound source.

The generating unit 420 may perform time modulation to output the audio signal so that audio signals output from the each loudspeaker overlap each other, thereby generating the beamforming signal on the horizontal plane related to the sound source.

The modulating unit 430 may modulate the beamforming signal generated by the generating unit 420 to be directed to a listener in the 3D space from the sound source. More particularly, the modulating unit 430 may modulate the beamforming signal using the beamforming signal on the horizontal plane and a beam angle from the sound source to the listener. That is, the modulating unit 430 may modulate the beamforming signal by applying a difference value based on the beamforming signal on the horizontal plane related to the sound source and the beam angle to the listener. Here, the difference value may be determined based on a shortest distance from the horizontal plane related to the sound source to the listener and the beamforming signal on the horizontal plane related to the sound source.

The modulating unit 430 may compensate for a difference value due to a position of the listener the beamforming signal generated by the generating unit 420, thereby outputting the beamforming signal to the position of the listener. Then, the modulating unit 430 may modulate the beamforming signal based on a position at which a loudspeaker array is disposed by correcting an audio signal level based on a proportion of a desired sound source position.

Figure 5:
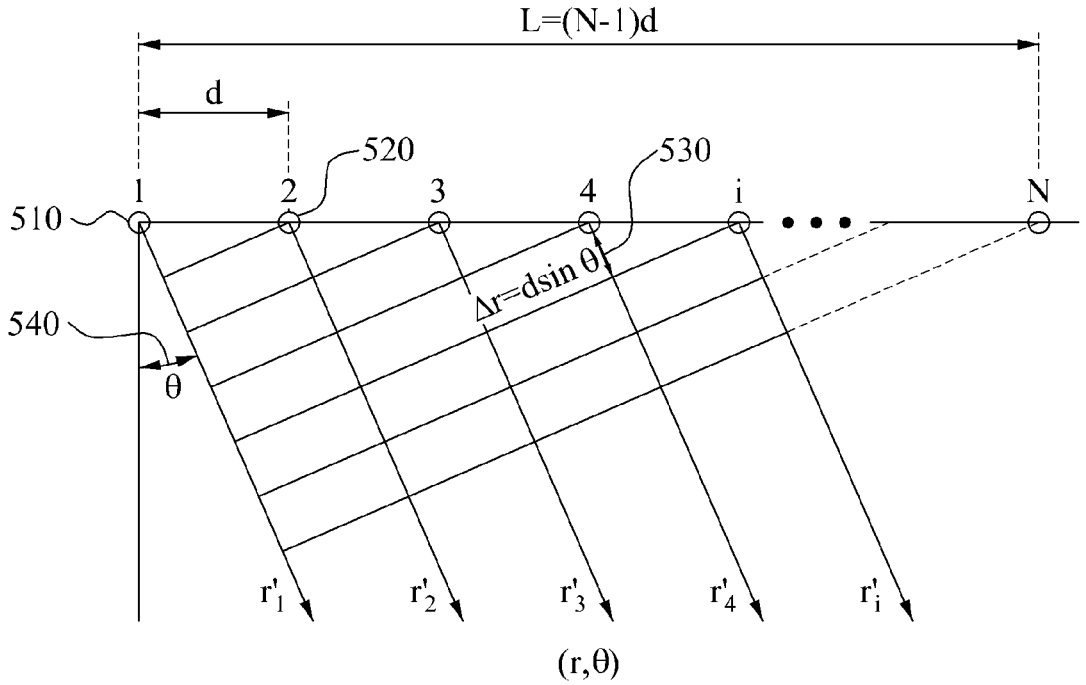
FIG. 5 illustrates an example of generating a beamforming signal on a plane horizontal to a loudspeaker array according to an exemplary embodiment of the present invention.

FIG. 5 illustrates an example of generating a beamforming signal on a plane horizontal to a loudspeaker array according to an exemplary embodiment of the present invention.

Referring to FIG. 5, a process of a beamforming signal being generated on the horizontal plane with the loudspeaker array by a generating unit is illustrated. The loudspeaker array may include a plurality of loudspeakers 510 to 530, which may be disposed at regular intervals.

The following description is based on a case in which a focused position on the horizontal plane with the loudspeaker array forms an angle of θ degrees, for example, 540 degrees, with a surface perpendicular to the loudspeaker array, and the loudspeakers 510 to 530 are disposed at a separation distance of d meters. For one loudspeaker array to output a beamforming signal to a coordinate (r, θ) on the horizontal plane at an angle of θ degrees, that is, 540 degrees, a delay may be calculated using Equation 1.

$$\sin(\theta)=c*\tau/d \qquad \text{[Equation 1]}$$

That is, an audio signal processing apparatus may calculate a delay (τ, sec) for each of the loudspeakers 510 to 530 to output an audio signal through Equation 1. Here, d is a separation distance between the loudspeakers 510 to 530 in the loudspeaker array, and c is a speed of a sound, that is, 343 meters/second (m/s).

For example, when delay time τ to output a beamforming signal to the horizontal plane at an angle of θ degrees, for example, 540 degrees, is 0.1 seconds, the audio signal processing apparatus enables the loudspeaker 520 to subsequently output an audio signal 0.1 seconds after the loudspeaker 510, and enables the loudspeaker 530 to output an audio signal 0.1 seconds after the loudspeaker 520. That is, each loudspeaker is allowed to output an audio signal 0.1 seconds later than a previous loudspeaker.

Figure 6:
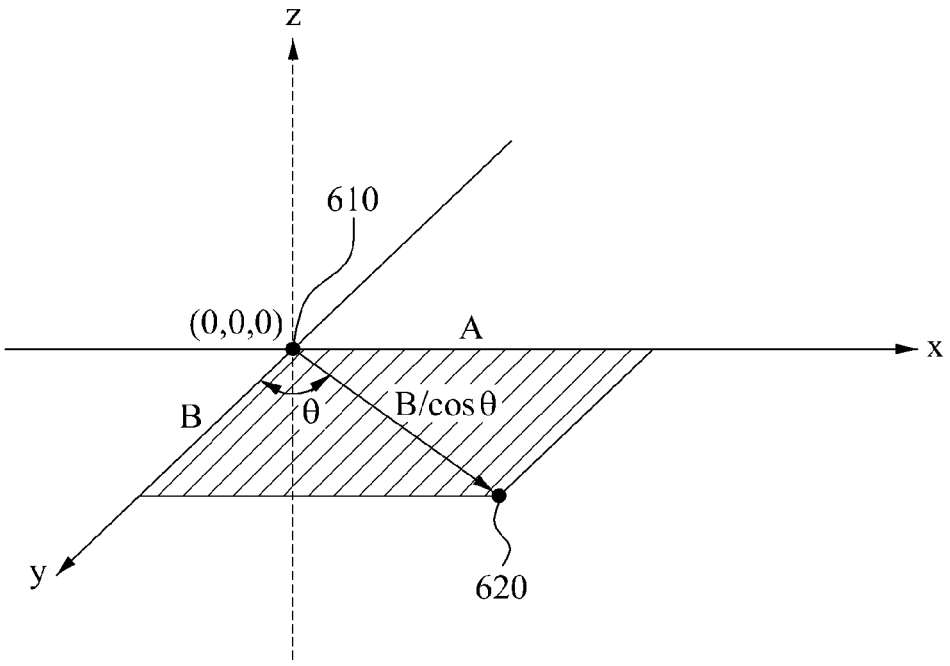
FIG. 6 illustrates an example of a beamforming signal that is output from a sound source to a plane horizontal to a loudspeaker array according to an exemplary embodiment of the present invention.

FIG. 6 illustrates an example of a beamforming signal that is output from a sound source to a plane horizontal to a loudspeaker array according to an exemplary embodiment of the present invention.

FIG. 6 illustrates a beamforming signal output from an origin 610 to a point 620 on a plane horizontal to the loudspeaker array, that is, an x-y coordinate plane, wherein the sound source is disposed on the plane horizontal to the loudspeaker array and is defined as the origin 610. The loudspeaker array outputs the beamforming signal at an angle of θ degrees with a surface perpendicular to the loudspeaker array, that is, a y-z coordinate plane.

Here, the beamforming signal output from the loudspeaker array at an angle of θ degrees may have a value of B/cos θ. Here, B may be an audio signal output from the loudspeaker array when a beam angle θ is 0 degrees. That is, B may be an audio signal output without being directed in a particular direction.

Figure 7:
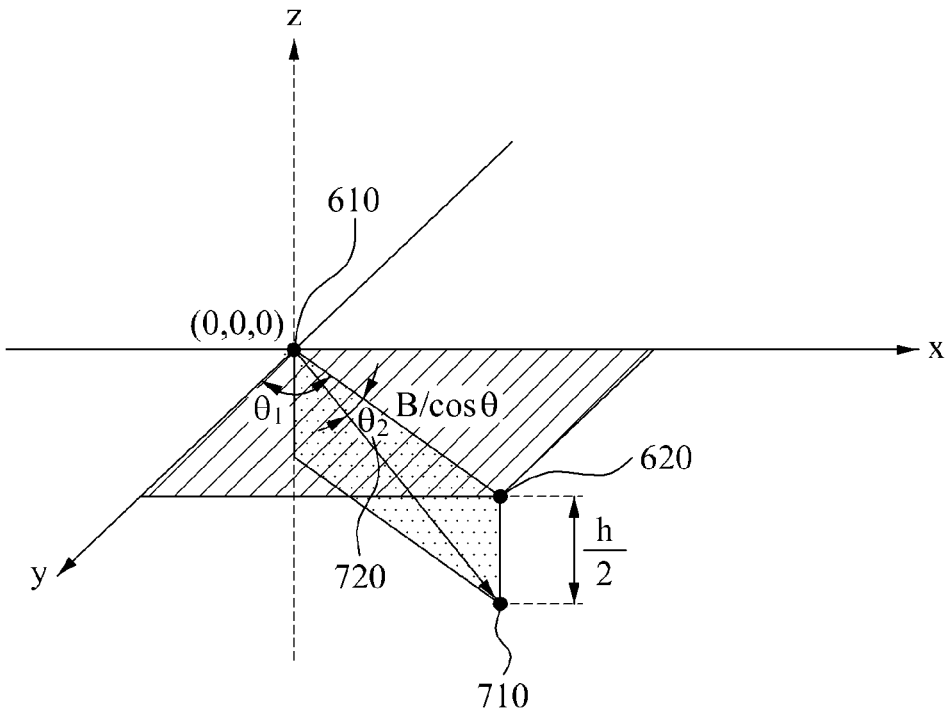
FIG. 7 illustrates an example of a beamforming signal that is output from a loudspeaker array to a position of a listener according to an exemplary embodiment of the present invention.

FIG. 7 illustrates an example of a beamforming signal that is output from a loudspeaker array to a position of a listener according to an exemplary embodiment of the present invention.

FIG. 7 illustrates a case in which a position 710 of a listener is midway between an upper loudspeaker array and a lower loudspeaker array which are disposed at a interval separation distance of h meters and the upper loudspeaker array outputs a beamforming signal to the position of the listener. Further, FIG. 7 illustrates a configuration to output the beamforming signal of FIG. 6 to a direction 710 of the listener.

As shown in FIG. 6, when the beamforming signal output from the origin 610, which is the sound source, to the spot 620 on the horizontal plane with the loudspeaker array, that is, the x-y coordinate plane, has a value of B/cos θ, the audio signal processing apparatus may modulate the beamforming signal to be output to the position 710 of the listener.

In this case, the audio signal processing apparatus may modulate the beamforming signal using a beam angle $\theta_2$ 720 from the origin 610 that is the sound source to the listener. That is, the audio signal processing apparatus may modulate the beamforming signal by applying a difference value based on the beamforming signal on the horizontal plane related to the sound source 610 and the beam angle $\theta_2$ 720 from the origin 610 that is the sound source to the listener.

Figure 8:
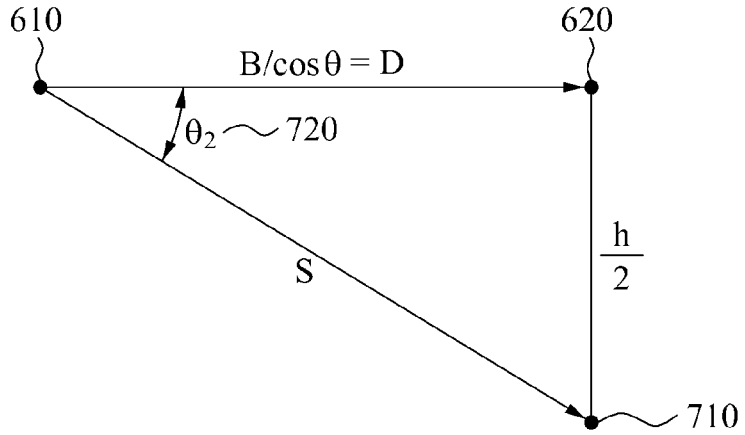
FIG. 8 illustrates an example of modulating a beamforming signal on a horizontal plane according to an exemplary embodiment of the present invention.

FIG. 8 illustrates an example of modulating a beamforming signal on a horizontal plane according to an exemplary embodiment of the present invention.

FIG. 8 illustrates the origin 610 that is the sound source and the position 710 of the listener form the beam angle $\theta_2$ 720, viewed from a z-plane of FIG. 7. FIG. 8 illustrates a case in which the position 710 of the listener is midway between an upper loudspeaker array and a lower loudspeaker array. Here, a shortest distance from the horizontal plane related to the sound source to the listener may be h/2.

In FIG. 8, when the value of B/cos θ is D, $\cos\theta_2=(B/\cos\theta)/S=D/S$ in Equation 2.

Thus, S may be calculated by Equation 3.

$$S=D/\cos\theta_2=(B/\cos\theta)/\cos\theta_2. \quad \text{[Equation 3]}$$

Equation 3 is arranged with respect to tan $\theta^2$ as follows in Equation 4.

$$\tan\theta_2=(h/2)/(B/\cos\theta)=(h/2)/D=h/(2*D) \quad \text{[Equation 4]}$$

Therefore, $\theta_2$ may be calculated by Equation 5.

$$\theta_2=\tan^{-1}((h*\cos\theta)/(2*B))=\tan^{-1}(h(2*D)). \quad \text{[Equation 5]}$$

When $\theta_2$ in Equation 5 is substituted into Equation 3, S may be calculated by Equation 6.

$$S=B(\cos\theta*\cos\theta)=B/(\cos\theta*\cos(\tan^{-1}((h*\cos\theta)/(2*B))))=D/\cos\theta_2=D/\cos(\tan^{-1}(h/(2*D)))=D/\cos(\tan^{-1}(h*\cos\theta)/(2*B)). \quad \text{[Equation 5]}$$

The audio signal processing apparatus may compensate for a difference value in the beamforming signal on the horizontal plane with respect to the loudspeaker array, due to the beam angle to the listener through Equation 6, thereby outputting the beamforming signal from the loudspeaker array to the listener. Referring to Equation 6, the difference value due to the beam angle to the listener may be cos $\theta_2$, cos(tan$^{-1}$(h/(2*D))), cos(tan$^{-1}$/(h*cos θ)/(2*B)). Thus, the difference value may be determined based on the shortest distance from the horizontal plane related to the sound source to the listener h/2 and the beamforming signal on the horizontal plane related to the sound source B/cos θ=D.

When an upper loudspeaker array and a lower loudspeaker array are disposed in the 3D space, beamforming occurs in upper and lower planes, and thus the audio signal processing apparatus may correct an audio signal level based on a proportion of a position of a sound source. For example, when the sound source is positioned between the upper loudspeaker array and the lower loudspeaker array, the audio signal processing apparatus compensates for a factor of $1/\sqrt{2}$ in a generated beamforming signal on the horizontal plane with the loudspeaker arrays, thereby outputting the beamforming signal to the 3D space.

A result of Equation 6 may correspond to a fact that a time difference is related to an amplitude difference due to a traveling distance for the time difference, when a waveform of the point sound source proceeding from one spot is viewed from a vertical plane.

Figure 9:
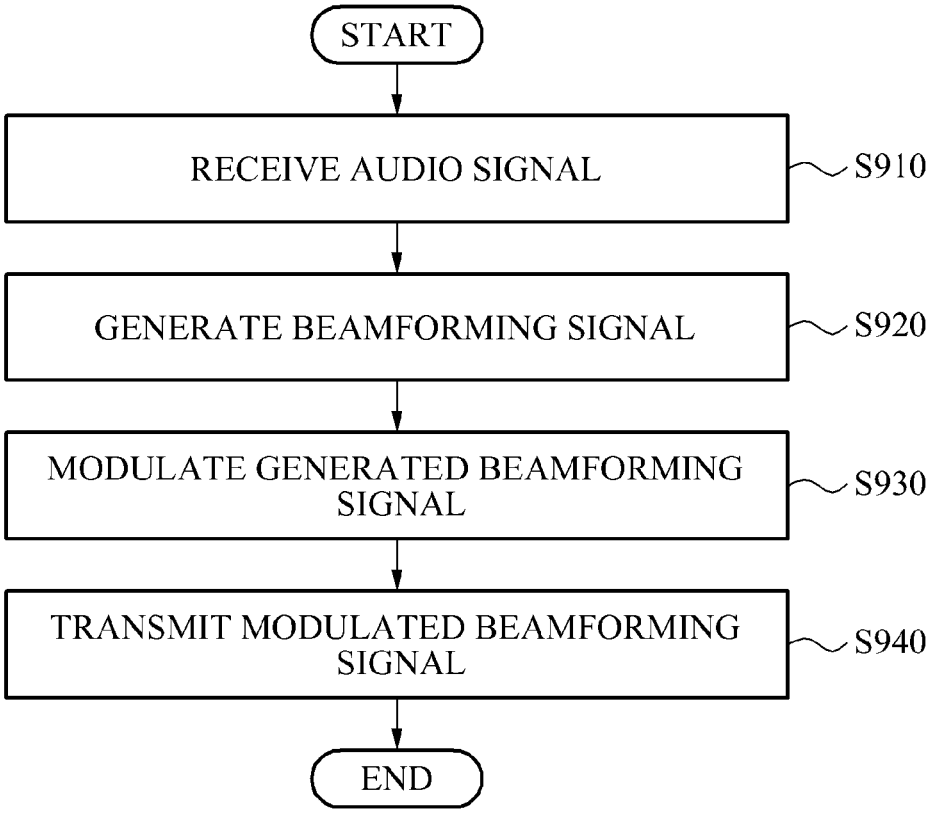
FIG. 9 is a flowchart illustrating a process of outputting a beamforming signal according to an exemplary embodiment of the present invention.

FIG. 9 is a flowchart illustrating a process of outputting a beamforming signal according to an exemplary embodiment of the present invention.

In operation S910, an audio signal processing apparatus may receive an audio signal for generating a beamforming signal.

In operation S920, an audio signal processing apparatus may generate a beamforming signal on a horizontal plane related to a sound source in a 3D space. The sound source may be generated based on at least one loudspeaker array.

The audio signal processing apparatus may generate the beamforming signal by outputting the audio signal based on a predetermined delay time from each loudspeaker forming a loudspeaker array. Here, the predetermined delay time may be set using an interval between loudspeakers forming the loudspeaker array and a beam angle on the horizontal plane related to the sound source.

In operation S930, the audio signal processing apparatus may modulate the beamforming signal to be directed to a listener in the 3D space from the sound source. The audio signal processing apparatus may modulate the beamforming signal using the beamforming signal on the horizontal plane and a beam angle from the sound source to the listener. Further, the audio signal processing apparatus may apply a difference value based on the beamforming signal on the horizontal plane related to the sound source and the beam angle. Here, the difference value may be determined based on a shortest distance from the horizontal plane related to the sound source to the listener and the beamforming signal on the horizontal plane related to the sound source.

The audio signal processing apparatus may compensate for a difference value due to a position of the listener in the beamforming signal on the horizontal plane related to the sound source, thereby generating the beamforming signal even in a disposition of the loudspeaker array in the 3D space. Further, the audio signal processing apparatus may modulate the beamforming signal based on a loudspeaker array disposition by correcting an audio signal level based on a proportion of a desired sound source position.

In operation S940, the audio signal processing apparatus may transmit the modulated beamforming signal through the loudspeaker array. The transmitted beamforming signal may be focused on the position of the listener even in a 3D disposition of the loudspeaker array.

The aforementioned apparatus can be embodied as a combination of a hardware element, a software element, and/or a combination of a hardware element and a software element. For example, the apparatus and the elements described in embodiments may be embodied using at least one universal computer or special purpose computer such as a processor, a controller, an arithmetic logic unit (ALU), a digital signal processor, a microcomputer, a field programmable array (FPA), a programmable logic unit (PLU), a microprocessor, or another apparatus for implementing and responding to an instruction. The processor may implement an operating system (OS) and at least one software application that is implemented on the OS. Also, the processor may approach, store, operate, process, and create data in response to the implementation of software. A single processor may be used for ease of understanding, however, those skilled in the art may appreciate that the processor may include a plurality of processing elements and/or a plurality of processing element types. For example, the processor may include a plurality of processors or a single controller. Also, another processing configuration such as a parallel processor may be possible.

The software may include alone or in combination with at least one of a computer program, a code and an instruction, configure the processor to operate as desired, or instruct the processor independently or collectively. The software and/or the data may be embodied permanently or temporarily in any type of machine, component, physical equipment, virtual equipment, computer storage medium or device, or transmitted signal wave, in order to be interpreted by the processor or to provide the processor with the instruction or the data. The software may be distributed on a computer system connected by a network, stored or implemented in the distributed method. The software and the data may be stored in one or more non-transitory computer-readable storage media.

Although a few exemplary embodiments of the present invention have been shown and described with reference to the accompanying drawings, the present invention is not limited to the described exemplary embodiments. Instead, it would be appreciated by those skilled in the art that various changes and modifications may be made to these exemplary embodiments without departing from the principles and spirit of the invention, the scope of which is defined by the claims and their equivalents. For example, even though the aforementioned processes and methods are carried out in different order from one described above and/or illustrated elements, such as systems, structures, devices and circuits, are combined or united in different forms from those described above or are replaced or substituted with other elements or equivalents, the same results may be achieved.

What is claimed is:

1. A method for processing an audio signal, the method comprising:

generating a beamforming signal on a horizontal plane related to a sound source in a three-dimensional (3D) space; and modulating the beamforming signal to be directed to a listener in the 3D space from the sound source, wherein the modulating of the beamforming signal comprises:

modulating the beamforming signal using the beamforming signal on the horizontal plane and a beam angle in relation to the sound source and the listener, and applying a difference value based on the beamforming signal on the horizontal plane and the beam angle.

2. The method of claim 1, wherein the difference value is determined based on a shortest distance from the horizontal plane to the listener and the beamforming signal on the horizontal plane.

3. The method of claim 1, wherein the sound source is generated based on at least one loudspeaker array.

4. The method of claim 1, wherein the generating of the beamforming signal comprises:

generating the beamforming signal by outputting an audio signal based on a predetermined delay time from each loud speaker forming the loudspeaker array.

5. The method of claim 4, wherein the predetermined delay time is set using a separation distance between loudspeakers forming the loudspeaker array and a beam angle on the horizontal plane.

6. A non-transitory computer-readable recording medium storing a program to implement the method of claim 1.

7. An apparatus for processing an audio signal, the apparatus comprising:

a generator to generate a beamforming signal on a horizontal plane related to a sound source in a three-dimensional (3D) space; and a modulator to modulate the beamforming signal to be directed to a listener in the 3D space from the sound source, wherein the modulator modulates the beamforming signal using the beamforming signal on the horizontal plane and a beam angle in relation to the sound source and the listener and applies a difference value based on the beamforming signal on the horizontal plane and the beam angle.

8. The apparatus of claim 7, wherein the difference value is determined based on a shortest distance from the horizontal plane to the listener and the beamforming signal on the horizontal plane.

9. The apparatus of claim 7, wherein the sound source is generated based on at least one loudspeaker array.

10. The apparatus of claim 7, wherein the generator generates the beamforming signal by outputting an audio signal based on a predetermined delay time from each loud speaker forming the loudspeaker array.

11. The apparatus of claim 10, wherein the predetermined delay time is set using a separation distance between loudspeakers forming the loudspeaker array and a beam angle on the horizontal plane.

12. An audio playback system comprising:

an audio signal processing apparatus to generate a beamforming signal on a horizontal plane related to a sound source in a three-dimensional (3D) space and to modulate the beamforming signal to be directed to a listener in the 3D space from the sound source; and a loudspeaker array to output the beamforming signal modulated by the audio signal processing apparatus through a plurality of loudspeakers, wherein the audio signal processing apparatus modulates the beamforming signal using the beamforming signal on the horizontal plane and a beam angle in relation to the sound source and the listener and applies a difference value based on the beamforming signal on the horizontal plane and the beam angle.

13. The audio playback system of claim 12, wherein the audio signal processing apparatus generates the beamforming signal by outputting an audio signal based on a predetermined delay time from each loud speaker forming the loudspeaker array.

14. The audio playback system of claim 13, wherein the predetermined delay time is set using a separation distance between loudspeakers forming the loudspeaker array and a beam angle on the horizontal plane.

* * * * *